US010214372B2

(12) United States Patent
Okubo et al.

(10) Patent No.: US 10,214,372 B2
(45) Date of Patent: Feb. 26, 2019

(54) SHEET FEEDER DEVICE AND IMAGE FORMING APPARATUS

(71) Applicant: Konica Minolta, Inc., Chiyoda-ku, Tokyo (JP)

(72) Inventors: Takahiro Okubo, Yokohama (JP); Yasuo Shiokawa, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/698,050

(22) Filed: Sep. 7, 2017

(65) Prior Publication Data

US 2018/0072521 A1 Mar. 15, 2018

(30) Foreign Application Priority Data

Sep. 9, 2016 (JP) ..... 2016-176736

(51) Int. Cl.

| | |
|---|---|
| ***B65H 1/14*** | (2006.01) |
| ***B65H 3/06*** | (2006.01) |
| *B65H 1/26* | (2006.01) |
| *B65H 7/20* | (2006.01) |

(52) U.S. Cl.

CPC ..... *B65H 3/0684* (2013.01); *B65H 1/14* (2013.01); *B65H 3/0661* (2013.01); *B65H 1/266* (2013.01); *B65H 7/20* (2013.01); *B65H 2515/50* (2013.01); *B65H 2801/06* (2013.01)

(58) Field of Classification Search

CPC ..... B65H 3/0684; B65H 5/008; B65H 2301/42342; B65H 2515/50

See application file for complete search history.

(56) References Cited

U.S. PATENT DOCUMENTS

| | | | | |
|---|---|---|---|---|
| 5,395,106 | A * | 3/1995 | Tohnai | G03G 15/6502 271/109 |
| 8,002,262 | B2 * | 8/2011 | Kelty | B65H 3/0684 271/10.03 |
| 9,296,580 | B2 * | 3/2016 | Sung | H04N 1/00652 |
| 9,670,019 | B2 * | 6/2017 | Murata | B65H 7/04 |
| 2014/0374984 | A1 * | 12/2014 | Morimoto | B65H 1/26 271/117 |
| 2017/0297838 | A1 * | 10/2017 | Hanamoto | B65H 3/0684 |

FOREIGN PATENT DOCUMENTS

JP H05032354 A 2/1993

* cited by examiner

*Primary Examiner* — Jeremy R Severson
(74) *Attorney, Agent, or Firm* — Cantor Colburn LLP

(57) ABSTRACT

A sheet feeder device includes: a pickup roller that separates paper sheets placed on a manual feed tray from one another, and transfers a paper sheet; a pair of sheet feed rollers that include an upper feed roller and a lower feed roller, form a sheet nip portion when the upper feed roller and the lower feed roller are pressed against each other, and transfer the paper sheet transferred from the pickup roller; a top edge vibrator that vibrates a top edge of the paper sheet, the top edge vibrator being located on an upstream side of the pair of sheet feed rollers; and a hardware processor that controls sheet feeding of the paper sheets placed on the manual feed tray, wherein, when a predetermined condition is satisfied in the sheet feeding, the hardware processor controls the top edge vibrator, to vibrate the top edge of the paper sheet.

13 Claims, 8 Drawing Sheets

FIG. 9

| | BASIS WEIGHT | RETRY |
|---|---|---|
| PLAIN PAPER | 64 TO 80 | × |
| | 81 TO 176 | × |
| | 177 TO 216 | × |
| | 217 TO 256 | × |
| | 257 TO 300 | △ |
| | 301 TO 450 | ○ |
| COATED PAPER | 64 TO 80 | × |
| | 81 TO 176 | × |
| | 177 TO 216 | × |
| | 217 TO 256 | △ |
| | 257 TO 300 | ○ |
| | 301 TO 450 | ○ |

FIG. 10

| | BASIS WEIGHT | RETRY | TYPE |
|---|---|---|---|
| PLAIN PAPER | 64 TO 80 | × | – |
| | 81 TO 176 | × | – |
| | 177 TO 216 | × | – |
| | 217 TO 256 | × | – |
| | 257 TO 300 | △ | A |
| | 301 TO 450 | ○ | A |
| COATED PAPER | 64 TO 80 | × | – |
| | 81 TO 176 | × | – |
| | 177 TO 216 | × | – |
| | 217 TO 256 | △ | B |
| | 257 TO 300 | ○ | B |
| | 301 TO 450 | ○ | B |

FIG. 11

| | BASIS WEIGHT | RETRY | NUMBER OF RETRIES | RETRY EXECUTION INTERVAL | JAM EXTENDED TIME |
|---|---|---|---|---|---|
| PLAIN PAPER | 64 TO 80 | × | – | – | – |
| | 81 TO 176 | × | – | – | – |
| | 177 TO 216 | × | – | – | – |
| | 217 TO 256 | × | – | – | – |
| | 257 TO 300 | △ | 3 | 40 | 240 |
| | 301 TO 450 | ○ | 5 | 40 | 400 |
| COATED PAPER | 64 TO 80 | × | – | – | – |
| | 81 TO 176 | × | – | – | – |
| | 177 TO 216 | × | – | – | – |
| | 217 TO 256 | △ | 10 | 10 | 200 |
| | 257 TO 300 | ○ | 15 | 10 | 300 |
| | 301 TO 450 | ○ | 20 | 10 | 400 |

SHEET FEEDER DEVICE AND IMAGE FORMING APPARATUS

CROSS-REFERENCE TO RELATED APPLICATIONS

The present application claims priority under 35 U.S.C. § 119 to Japanese Patent Application No. 2016-176736, filed on Sep. 9, 2016, the entire content of which are incorporated herein by reference.

BACKGROUND

Technological Field

The present invention relates to a sheet feeder device and an image forming apparatus including the sheet feeder device.

Description of the Related Art

A conventionally-known electrophotographic image forming apparatus forms a toner image by developing an electrostatic latent image formed on a photosensitive member with toner, transfers the formed toner image onto a paper sheet, and heats and fixes the transferred toner image, to form an image on the paper sheet.

The above image forming apparatus normally has a manual feed tray to feed a small number of sheets that include various kinds of media. To feed various kinds of media from the manual feed tray, the conveyance path from the manual feed tray is designed to reduce resistance so that each paper sheet can move as linearly as possible.

However, in a case where the conveyance path from the manual feed tray is preferentially made linear, the apparatus needs to be made larger in size in balance with the other conveyance paths such as the conveyance path from a paper feeder unit (PFU) and the conveyance path from a large-capacity paper feeder unit (LU).

Therefore, the conveyance path from the manual feed tray is designed to bend, so that various kinds of media can be fed into the apparatus while the apparatus is made smaller in size.

However, there is an increasing demand for higher degrees of compatibility with media (particularly, heavy paper), and it is critical to feed paper sheets having higher rigidity than conventionally used paper sheets.

In view of this, JP 5-32354 A discloses a technique for increasing the efficiency of sheet conveyance. When a failure in document feeding is detected after a separating conveyance operation to separate a paper sheet from paper sheets stacked on a tray, the separating conveyance operation is again started, so that the rate of occurrence of a document feed failure can be lowered.

However, to prevent a paper jam when the top edge of a paper sheet (particularly, a paper sheet having high rigidity) cannot enter a sheet nip portion formed between sheet feed rollers pressed against each other due to bending of a conveyance path or the like, the technique disclosed in JP 5-32354 A can only repeat the separating conveyance operation, but cannot move the top edge of the paper sheet up and down. Therefore, the top edge of the paper sheet cannot be guided to the sheet nip portion, and it is difficult to solve the paper jam.

SUMMARY

An object of the present invention is to provide a sheet feeder device and an image forming apparatus including the sheet feeder device.

To achieve the abovementioned object, according to an aspect of the present invention, a sheet feeder device reflecting one aspect of the present invention comprises:

a pickup roller that separates paper sheets placed on a manual feed tray from one another, and transfers a paper sheet;

a pair of sheet feed rollers that include an upper feed roller and a lower feed roller, form a sheet nip portion when the upper feed roller and the lower feed roller are pressed against each other, and transfer the paper sheet transferred from the pickup roller;

a top edge vibrator that vibrates a top edge of the paper sheet, the top edge vibrator being located on an upstream side of the pair of sheet feed rollers in a conveyance direction; and a hardware processor that controls sheet feeding of the paper sheets placed on the manual feed tray, wherein, when a predetermined condition is satisfied in the sheet feeding, the hardware processor controls the top edge vibrator, to vibrate the top edge of the paper sheet.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention:

FIG. 9 is an example of a table that shows correspondence between paper type conditions of paper sheets and execution/non-execution of the retry operation on the pickup roller at the start of sheet feeding;

FIG. 10 is an example of a table that shows correspondence between paper type conditions of paper sheets and operation types at a time of execution of the retry operation on the pickup roller; and FIG. 11 is an example of a table that shows correspondence among paper type conditions of paper sheets, the number of times the retry operation is to be performed on the pickup roller, the intervals at which the retry operation is to be performed, and the extended amount of time before a paper jam is detected.

DETAILED DESCRIPTION OF EMBODIMENTS

Hereinafter, one or more embodiments of the present invention will be described in detail with reference to the drawings. However, the scope of the invention is not limited to the disclosed embodiments.

Figure 1:
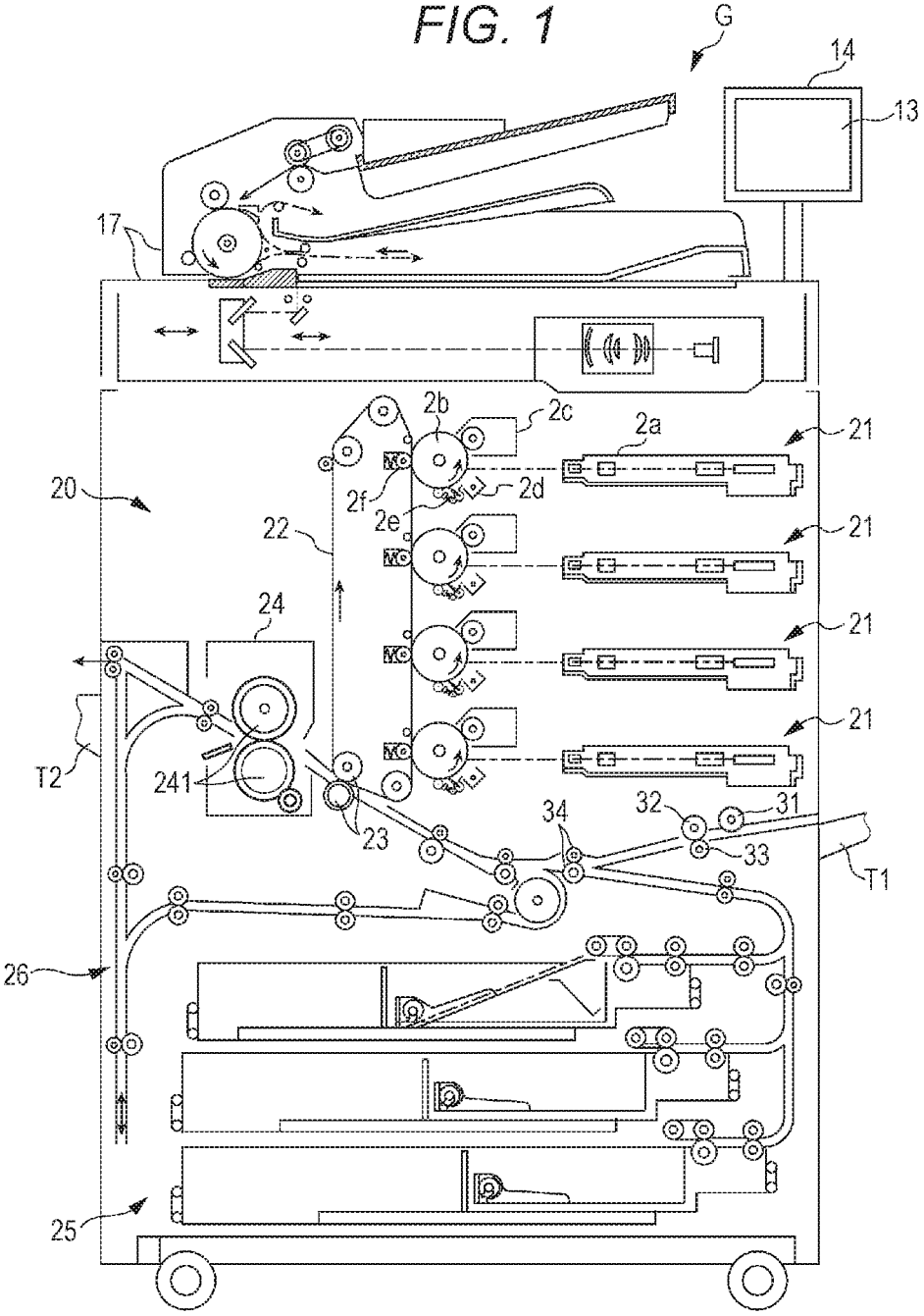
FIG. 1 is a schematic front view of the structure of an image forming apparatus according to an embodiment.

An image forming apparatus G according to this embodiment includes an image forming part 20 as shown in FIG. 1, and forms an image on a paper sheet with the image forming part 20 using a color material such as toner.

Figure 2:
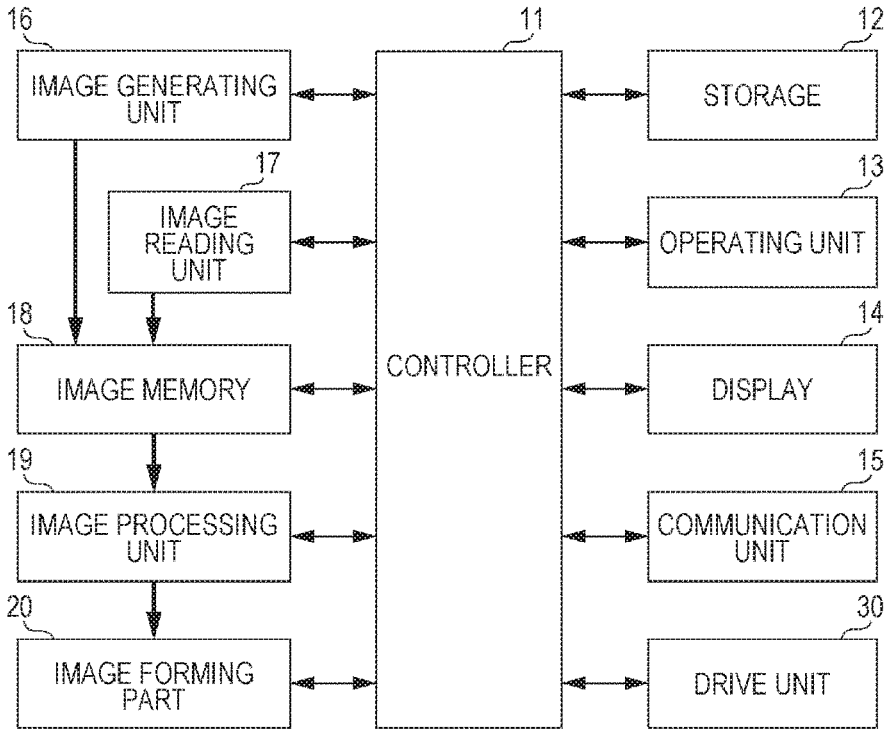
FIG. 2 is a functional block diagram showing the control configuration of the image forming apparatus according to this embodiment.

As shown in FIGS. 1 and 2, the image forming apparatus G includes a controller 11, a storage 12, an operating unit 13, a display 14, a communication unit 15, an image generating unit 16, an image reading unit 17, an image memory 18, an image processing unit 19, the image forming part 20, and a drive unit 30.

The controller 11 is formed with a CPU, a RAM, and the like. By reading various programs from the storage 12 and executing the programs, the controller 11 controls the respective components.

For example, the controller 11 controls the image processing unit 19 to perform image processing on an original image that has been generated by the image generating unit 16 or the image reading unit 17 and is stored in the image memory 18. The controller 11 then controls the image forming part 20 to form an image on a paper sheet in accordance with the original image subjected to the image processing.

The storage 12 stores programs that can be read by the controller 11, and files and the like to be used in executing the programs. The storage 12 may be a large-capacity memory, such as a hard disk.

As shown in FIG. 1, the operating unit 13 and the display 14 are provided as user interfaces on an upper portion of the image forming apparatus G.

The operating unit 13 generates an operation signal in accordance with a user operation, and outputs the operation signal to the controller 11. The operating unit 13 may be a keypad, a touch panel integrated with the display 14, or the like.

The display 14 displays an operation screen or the like in accordance with an instruction from the controller 11. The display 14 may be a liquid crystal display (LCD), an organic electro-luminescence display (OELD), or the like.

The communication unit 15 communicates with an external device in a network, such as a user terminal, a server, or another image forming system.

The communication unit 15 receives vectorial data from a user terminal via a network. In the vectorial data, an instruction to form an image is written in a page description language (PDL).

The image generating unit 16 rasterizes the vectorial data received by the communication unit 15, and generates an original image in a bitmap format. In the original image, each pixel has pixel values of the four colors; cyan (C), magenta (M), yellow (Y), and black (K). A pixel value is a data value representing a gradation in an image, and an 8-bit data value represents a gradation at levels 0 to 255, for example.

The image reading unit 17 is formed with an automatic document feeder, a scanner, and the like, as shown in FIG. 1. The image reading unit 17 reads a surface of a document set on a platen, and generates an original image in a bitmap format. In the original image generated by the image reading unit 17, each pixel has pixel values of the three colors: red (R), green (G), and blue (B). This original image is subjected to color conversion, and is converted into an original image having pixel values of the four colors C, M, Y, and K by a color converting unit (not shown).

The image memory 18 is a buffer memory that temporarily stores an original image generated by the image generating unit 16 or the image reading unit 17. The image memory 18 may be a dynamic RAM (DRAM) or the like.

The image processing unit 19 reads the original image from the image memory 18, and performs image processing, such as a density correction process or a halftone process, on the original image.

The density correction process is a process to convert the pixel values of the respective pixels of the original image into pixel values that are corrected so that the density of the image formed on a paper sheet matches the target density.

The halftone process is a process for reproducing a halftone in a simulative manner, and may be an error diffusion process, a screen process using an organizational dither method, or the like.

The image forming part 20 forms an image formed with the four colors C, M, Y, and K on a paper sheet, in accordance with the pixel values of the four colors of the respective pixels in the original image subjected to the image processing by the image processing unit 19.

As shown in FIG. 1, the image forming part 20 includes four writing units 21, an intermediate transfer belt 22, a pair of secondary transfer rollers 23, a fixing device 24, a sheet feed tray 25, a manual sheet feed tray (hereinafter referred to as the manual feed tray) T1, and a sheet catch tray T2.

The four writing units 21 are arranged in series (in tandem) along the belt surface of the intermediate transfer belt 22, and forms images in the respective colors C, M, Y, and K. The respective writing units 21 have the same structures, except that the colors of the images to be formed are different from one another. As shown in FIG. 1, each writing unit 21 includes an optical scanner 2*a*, a photosensitive member 2*b*, a developing unit 2*c*, a charging unit 2*d*, a cleaning unit 2*e*, and a primary transfer roller 2*f*.

At a time of image formation, after the photosensitive member 2*b* is electrically charged by the charging unit 2*d*, each writing unit 21 forms an electrostatic latent image by scanning the photosensitive member 2*b* with a flux of light emitted from the optical scanner 2*a* in accordance with the original image. The developing unit 2*c* performs development by supplying a color material such as toner, so that an image is formed on the photosensitive member 2*b*.

The images formed on the respective photosensitive members 2*b* of the four writing units 21 are sequentially transferred onto the intermediate transfer belt 22 in an overlapping manner by the respective primary transfer rollers 2*f* (this process is the primary transfer). Consequently, an image formed with the respective colors is formed on the intermediate transfer belt 22. The intermediate transfer belt 22 is an image carrier that is turned by rollers. After the primary transfer, the cleaning unit 2*e* removes the remaining color material from the photosensitive member 2*b*.

A paper sheet is supplied from the manual feed tray T1 or the sheet feed tray 25 to the image forming part 20 in time for the image on the turning intermediate transfer belt 22 reaching the position of the pair of secondary transfer rollers 23. Of the pair of secondary transfer rollers 23, one roller is pressed against the intermediate transfer belt 22, and the other roller serves as one of the rollers that turn the intermediate transfer belt 22. As the pair of secondary transfer rollers 23 are pressed against each other, the image is transferred from the intermediate transfer belt 22 onto the paper sheet (this process is called the secondary transfer). The paper sheet is then conveyed to the fixing device 24 and is subjected to a fixing process. The paper sheet is then ejected onto the sheet catch tray T2. The fixing process is a process of heating and pressing the paper sheet with a pair of fixing rollers 241, to fix the image to the paper sheet. In a case where images are to be formed on both surfaces of a paper sheet, the paper sheet is conveyed into a reverse path 26, is reversed, and is then returned to the position of the pair of secondary transfer rollers 23.

When a paper sheet placed on the manual feed tray T1 is sent to the pair of secondary transfer rollers 23, the drive unit 30 causes a pickup roller 31 to rotate, under the control of the controller 11. If a predetermined condition is satisfied at the time of the above sheet feed, the drive unit 30 causes the pickup roller 31 to move up and down while rotating, under the control of the controller 11. By doing so, the drive unit 30 performs an operation to separate the pickup roller 31 from the paper sheet or an operation to press the pickup roller 31 against the paper sheet. In this embodiment, an operation to separate the pickup roller 31 from a paper sheet and an operation to re-press the pickup roller 31 against the paper sheet is defined as a retry operation.

Figure 3:
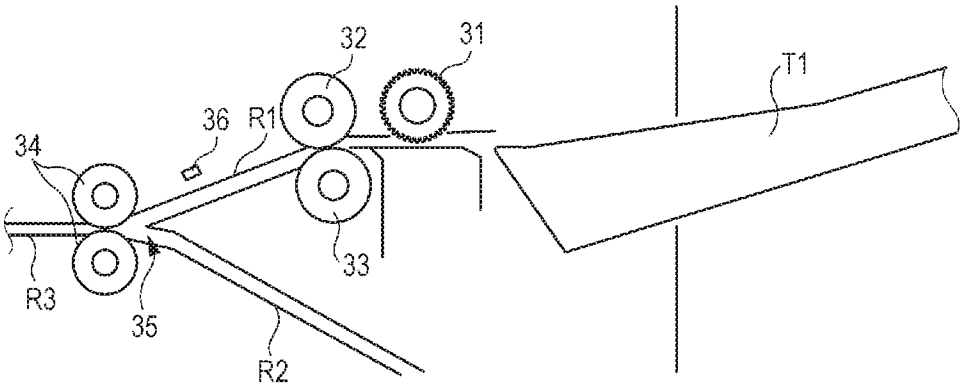
FIG. 3 is a diagram showing the sheet conveyance path from a manual feed tray to a pair of secondary transfer rollers.

Referring now to FIG. 3, the sheet conveyance path from the manual feed tray T1 to the pair of secondary transfer rollers 23 is described.

In the sheet conveyance path from the manual feed tray T1 to the pair of secondary transfer rollers 23, the pickup roller 31, a pair of sheet feed rollers consisting of a sheet feed roller (upper feed roller) 32 and a separating roller (lower feed roller) 33, and a pair of conveyance rollers 34 are arranged in this order from the upstream side in the direction of conveyance. In this embodiment, the sheet feed roller 32 and the separating roller 33 are pressed against each other, to form a sheet nip portion.

As shown in FIG. 3, the manual feed tray T1 is located at a higher position than the sheet nip portion.

The pickup roller 31 picks up paper sheets from the loading position on the manual feed tray T1, and sends the paper sheets to the pair of sheet feed rollers (the sheet feed roller 32 and the separating roller 33).

The pair of sheet feed rollers separate the paper sheets sent from the pickup roller 31 from one another, and send each paper sheet to the pair of conveyance rollers 34.

The pair of conveyance rollers 34 send each paper sheet sent from the pair of sheet feed rollers or each paper sheet conveyed from the sheet feed tray 25 via a conveyance path R2, to the pair of secondary transfer rollers 23 via a conveyance path R3.

The sheet conveyance path R1 from the manual feed tray T1 to the pair of conveyance rollers 34 is designed to bend between the pickup roller 31 and the pair of sheet feed rollers (the sheet feed roller 32 and the separating roller 33). As the pair of conveyance rollers are provided after the conveyance path R1 designed to bend immediately after the pair of sheet feed rollers as described above, the size of the apparatus can be reduced.

The path from the conveyance path R1 to the conveyance path R3, and the path from the conveyance path R2 to the conveyance path R3 are designed to bend at the joining point 35 between the conveyance path R1 and the conveyance path R2.

A sensor 36 that detects the top edge of a paper sheet being conveyed in the conveyance path R1 toward the pair of conveyance rollers 34 is provided before the joining point 35 in the conveyance path R1.

Detecting the top edge of a paper sheet being conveyed in the conveyance path R1 toward the pair of conveyance rollers 34, the sensor 36 outputs information indicating the detection to the controller 11. That is, the sensor 36 functions as a top edge detector of the present invention.

The sheet feeder device of the present invention includes at least a top edge vibrator (the pickup roller 31), the pair of sheet feed rollers (the sheet feed roller 32 and the separating roller 33), and the controller 11.

Referring now to FIGS. 4 through 7, an operation of the image forming apparatus G according to this embodiment is described. This operation is started when the controller 11 receives an instruction to feed a paper sheet from the manual feed tray T1.

Figure 4:
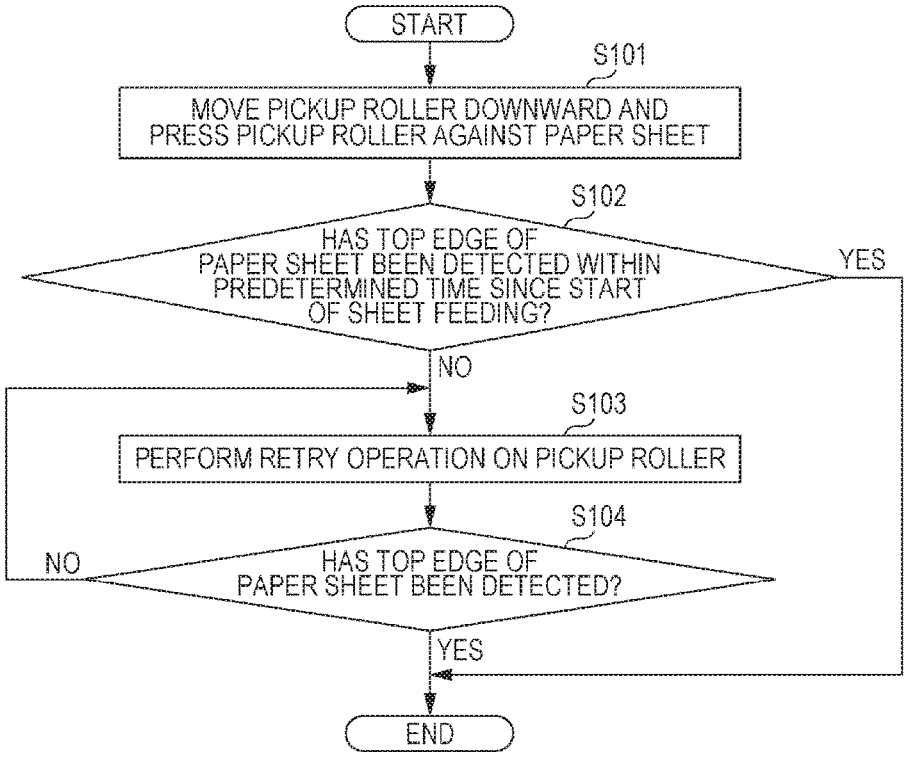
FIG. 4 is a flowchart showing an operation of the image forming apparatus according to this embodiment.
Figure 5:
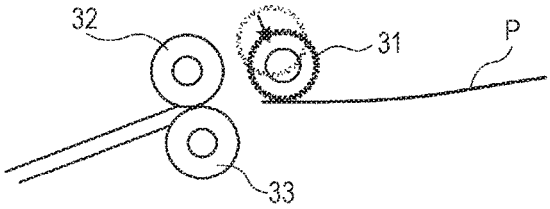
FIG. 5 is a diagram showing an example operation to bring a pickup roller into contact with a paper sheet placed on the manual feed tray.

As shown in the flowchart in FIG. 4, the controller 11 first controls the drive unit 30, to move the pickup roller 31 downward while rotating the pickup roller 31, and bring the pickup roller 31 into contact with (or press the pickup roller 31 against) a paper sheet placed on the manual feed tray T1 (step S101). FIG. 5 shows an example of the operation to bring the pickup roller 31 into contact with a paper sheet P placed on the manual feed tray T1.

The controller 11 then determines whether the top edge of the paper sheet has been detected within a predetermined time since the start of the sheet feeding (step S102). Here, the predetermined time is such a time that a paper jam can be detected at the sheet nip portion formed by pressing the sheet feed roller 32 and the separating roller 33 against each other, for example. In step S102, if information indicating that the top edge of the paper sheet has been detected has been output from the sensor 36 before the predetermined time has passed since the start of the sheet feed, the controller 11 determines that the top edge of the paper sheet has been detected within the predetermined time since the start of the sheet feed.

If the controller 11 determines that the top edge of the paper sheet has been detected within the predetermined time since the start of the sheet feeding (step S102: YES), the controller 11 determines that any paper jam has not occurred at the sheet nip portion, and ends the process.

If the controller 11 determines that the top edge of the paper sheet has not been detected within the predetermined time since the start of the sheet feeding (step S102: NO), on the other hand, the controller 11 determines that a paper jam may have occurred at the sheet nip portion, and moves on to the next step S103.

The controller 11 then controls the drive unit 30, to perform a retry operation (which is an operation to move the pickup roller 31 upward (an operation to separate the pickup roller 31 from the paper sheet) and an operation to move the pickup roller 31 downward (an operation to re-press the pickup roller 31 against the paper sheet)), while rotating the pickup roller 31 (step S103).

FIGS. 6A through 6E show an example of a retry operation performed on the pickup roller 31. FIG. 7 shows an example of the behavior of the top edge of the paper sheet during the retry operation performed on the pickup roller 31.

Figure 6A:
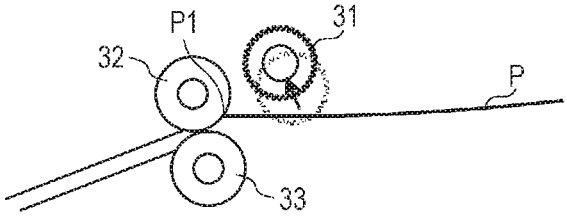
FIGS. 6A through 6E are diagrams showing an example of a retry operation performed on the pickup roller.
Figure 7:
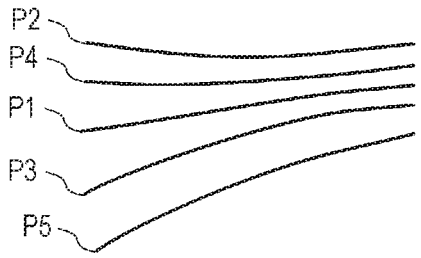
FIG. 7 is a diagram showing an example of the behavior of the top edge of a paper sheet during the retry operation performed on the pickup roller.

FIG. 6A is a diagram showing an example of a situation where an operation to separate the pickup roller 31 from the paper sheet P is performed, while the top edge P1 of the paper sheet P is in contact with the sheet feed roller 32.

Figure 6B:
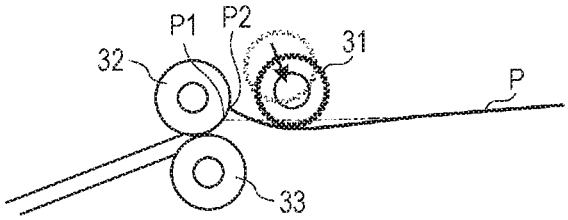

FIG. 6B is a diagram showing an example of a situation where an operation to re-press the pickup roller 31 against the paper sheet P is performed in the state shown in FIG. 6A. In the example shown in FIG. 6B, as the pickup roller 31 is re-pressed against the paper sheet P, the top edge P2 of the paper sheet P moves upward from the position of the top edge P1 in the example shown in FIG. 6A.

Figure 6C:
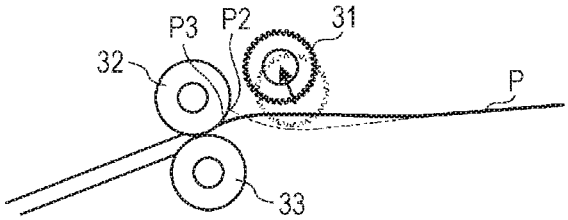

FIG. 6C is a diagram showing an example of a situation where an operation to separate the pickup roller 31 from the paper sheet P is performed in the state shown in FIG. 6B. In the example shown in FIG. 6C, as the pickup roller 31 is separated from the paper sheet P, a reaction force (a force to return to the original shape) against the pressing force from the pickup roller 31 is generated, and the top edge P3 of the paper sheet P moves downward from the position of the top edge P2 in the example shown in FIG. 6B.

Figure 6D:
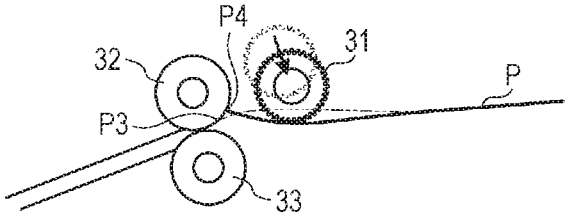

FIG. 6D is a diagram showing an example of a situation where an operation to re-press the pickup roller 31 against the paper sheet P is performed in the state shown in FIG. 6C. In the example shown in FIG. 6D, as the pickup roller 31 is re-pressed against the paper sheet P, the top edge P4 of the paper sheet P moves upward from the position of the top edge P3 in the example shown in FIG. 6C.

Figure 6E:
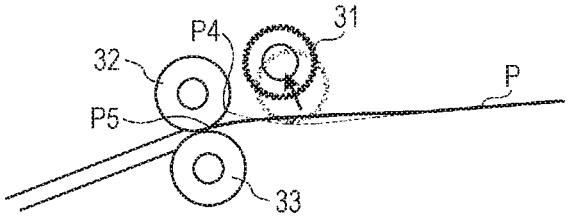

FIG. 6E is a diagram showing an example of a situation where an operation to separate the pickup roller 31 again from the paper sheet P is performed in the state shown in FIG. 6D. In the example shown in FIG. 6E, as the pickup roller 31 is separated again from the paper sheet P, a reaction force against the pressing force from the pickup roller 31 is generated, and the top edge P5 of the paper sheet P moves downward from the position of the top edge P4 in the example shown in FIG. 6D, to enter the sheet nip portion.

As shown in FIGS. 6A through 6E and FIG. 7, in this embodiment, a retry operation is repeatedly performed on the pickup roller 31, so that the top edge of the paper sheet can be vibrated. Thus, the top edge of the paper sheet can be moved to such a position that the top edge can enter the sheet nip portion.

That is, the pickup roller 31 functions as a top edge vibrator of the present invention. In this embodiment, vibrating the top edge of a paper sheet is performing the retry operation at least once. Therefore, in the present invention, vibrating the top edge of a paper sheet may be moving the top edge of a paper sheet up and down through only a one-time retry operation.

The controller 11 then determines whether the top edge of the paper sheet has been detected (step S104).

If the controller 11 determines that the top edge of the paper sheet has been detected (step S104: YES), the controller 11 determines that the paper sheet has passed through the sheet nip portion, and ends the process.

If the controller 11 determines that the top edge of the paper sheet has not been detected yet (step S104: NO), on the other hand, the controller 11 determines that the paper sheet has not passed through the sheet nip portion, and then moves on to step S103, to continue the retry operation on the pickup roller 31. After vibrated, the top edge of the paper sheet is preferably vibrated at predetermined time intervals (or the retry operation is performed) until the top edge of the paper sheet is detected by the sensor 36.

As described above, the image forming apparatus G according to this embodiment includes: the pickup roller 31 that separates paper sheets placed on the manual feed tray T1 from one another, and transfers the paper sheets; the pair of sheet feed rollers (the sheet feed roller 32 and the separating roller 33) that include the upper feed roller (the sheet feed roller 32) and the lower feed roller (the separating roller 33), form a sheet nip portion when the upper feed roller and the lower feed roller are pressed against each other, and transfer each paper sheet transferred from the pickup roller 31; the top edge vibrator (the pickup roller 31) that is located on the upstream side of the pair of sheet feed rollers in the conveyance direction, and vibrates the top edge of each paper sheet; and the controller 11 that controls the feeding of the paper sheets placed on the manual feed tray T1. If a predetermined condition is satisfied at a time of sheet feeding, the controller 11 controls the top edge vibrator, to vibrate the top edge of a paper sheet.

With the image forming apparatus G according to this embodiment, the position of the top edge of a paper sheet can be vibrated (moved up and down). Thus, a paper jam at the sheet nip portion can be prevented, and the efficiency of conveyance of paper sheets having high rigidity can be increased.

Particularly, in the image forming apparatus G according to this embodiment, the pickup roller 31 functions as the top edge vibrator. If a predetermined condition is satisfied at a time of sheet feeding, the controller 11 performs an operation to separate the pickup roller 31 from a paper sheet and an operation to press the pickup roller 31 against the paper sheet. In this manner, the top edge of the paper sheet is vibrated.

Therefore, with the image forming apparatus G according to this embodiment, there is no need to prepare a component for vibrating the top edge of each paper sheet. Thus, an increase in size and an increase in costs of the apparatus can be prevented.

The image forming apparatus G according to this embodiment also includes a top edge detector (the sensor 36) that is provided on the downstream side of the pair of sheet feed rollers in the conveyance direction, and detects the top edge of each paper sheet. In a case where the top edge detector fails to detect the top edge of a paper sheet within a predetermined time since the start of sheet feeding, the controller 11 vibrates the top edge of the paper sheet.

Accordingly, with the image forming apparatus G according to this embodiment, the top edge of a paper sheet can be vibrated when a paper jam appears to have occurred at the sheet nip portion. Thus, it is possible to increase the efficiency of conveyance of paper sheets having high rigidity, without a decrease in productivity.

Also, in the image forming apparatus G according to this embodiment, after vibrating the top edge of a paper sheet, the controller 11 vibrates the top edge of the paper sheet at predetermined time intervals until the top edge of the paper sheet is detected by the top edge detector.

Accordingly, with the image forming apparatus G according to this embodiment, the retry operation can be repeatedly performed until the paper sheet has passed through the sheet nip portion. Thus, it is possible to increase the efficiency of conveyance of paper sheets in a more reliable manner.

Further, in the image forming apparatus G according to this embodiment, the conveyance path for paper sheets placed on the manual feed tray T1 is designed to bend between the pickup roller 31 and the pair of sheet feed rollers.

Accordingly, with the image forming apparatus G according to this embodiment, it is possible to prevent paper jams at the sheet nip portion while reducing the size of the apparatus. Thus, paper sheets can be conveyed with a higher efficiency in an apparatus having a reduced size.

Also, in the image forming apparatus G according to this embodiment, the manual feed tray T1 is located at a higher position than the sheet nip portion.

If a paper jam occurs at the sheet nip portion in the image forming apparatus G according to this embodiment, the bottom edge of the paper sheet bends upward. Accordingly, the vibration of the top edge of the paper sheet can be increased when the pickup roller 31 is pressed against the paper sheet. Thus, the top edge of the paper sheet can be easily guided to the sheet nip portion.

Although an embodiment according to the present invention has been described in detail, the present invention is not limited to the above described embodiment, and changes may be made to the embodiment without departing from the scope of the invention.

For example, although the pickup roller 31 is used as the top edge vibrator in the above described embodiment, the present invention is not limited to that. The retry operation may not be performed on the pickup roller 31. Instead, a member for vibrating the top edge of each paper sheet is provided between the pickup roller 31 and the pair of sheet feed rollers, and this member is vibrated so that the top edge of each paper sheet is vibrated.

Also, in the above described embodiment, when the retry operation is performed on the pickup roller 31, the pickup roller 31 is moved upward, and thus, is separated from the paper sheet. However, the present invention is not limited to that. In an operation to move the pickup roller 31 upward, the pickup roller 31 may be moved upward in such a manner as not to be separated from the paper sheet, for example. With this, the moving distance of the pickup roller 31 can be made shorter than in a case where the pickup roller 31 is completely separated from the paper sheet. Accordingly, the cycles of moving the pickup roller 31 up and down can be shortened. Thus, the time required for the retry operation can be shortened.

Figure 8:
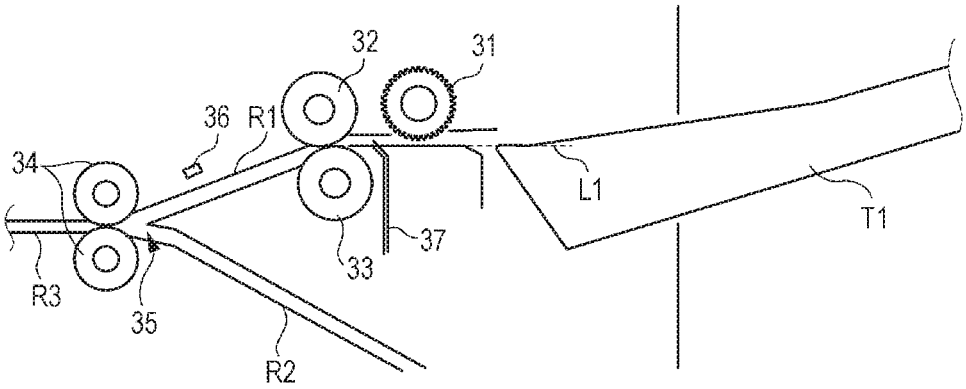
FIG. 8 is a diagram showing a modification of the sheet conveyance path from the manual feed tray to the pair of secondary transfer rollers.

Alternatively, a preliminary separating plate 37 may be provided between the pickup roller 31 and the pair of sheet feed rollers, as shown in FIG. 8. In this case, this preliminary separating plate 37 is preferably positioned so as to protrude upward from the straight line L1 connecting the upper limit position of a paper sheet placed on the manual feed tray T1 to the sheet nip portion. Here, the upper limit position of a paper sheet placed on the manual feed tray T1 is the position of a paper sheet to be fed, or the sheet feed starting position.

As the preliminary separating plate 37 is provided so as to protrude upward from the straight line L1 connecting the upper limit position of a paper sheet placed on the manual feed tray T1 to the sheet nip portion as described above, each paper sheet can be made to bend further upward during the pressing operation. Accordingly, the top edge of each paper sheet easily vibrates during the separating operation. Thus, the top edge of each paper sheet can be easily moved to a position from which the top edge can enter the sheet nip portion.

Further, in the above described embodiment, the manual feed tray T1 is located at a higher position than the sheet nip portion. However, the present invention is not limited to that. For example, the manual feed tray T1 may be located at a lower position than the sheet nip portion, or may be located at the same height as the sheet nip portion.

In a case where the paper sheet satisfies a predetermined paper type condition, the retry operation on the pickup roller 31 may be started at the start of sheet feeding.

FIG. 9 shows an example of a table that shows correspondence between paper type conditions (paper types and basis weights) of paper sheets and execution/non-execution of the retry operation on the pickup roller 31 at the start of sheet feeding. In the example shown in FIG. 9, execution/non-execution of the retry operation at the start of sheet feeding is classified into the three levels: "○: the retry operation is performed at the start of sheet feeding", "Δ: execution of the retry operation at the start of sheet feeding can be selected by the user", and "×: the retry operation is not performed at the start of sheet feeding".

As shown in FIG. 9, in cases where the paper sheet is "plain paper", execution/non-execution of the retry operation is determined to be "×" when the basis weight is "64 to 256 gsm", is determined to be "Δ" when the basis weight is "257 to 300 gsm", and is determined to be "○" when the basis weight is "301 to 450 gsm". In cases where the paper sheet is "coated paper", execution/non-execution of the retry operation is determined to be "×" when the basis weight is "64 to 216 gsm", is determined to be "Δ" when the basis weight is "217 to 256 gsm", and is determined to be "○" when the basis weight is "257 to 450 gsm".

That is, in the example shown in FIG. 9, whether the paper sheet is "plain paper" or "coated paper", the retry operation is performed on the pickup roller 31 at the start of sheet feeding, if the basis weight of the paper sheet is larger.

The paper type conditions of paper sheets are not necessarily paper types and basis weights, but may be some other conditions, such as degrees of rigidity and surface properties of paper sheets.

As described above, in a case where the paper sheet satisfies predetermined paper type conditions, the retry operation is performed on the pickup roller 31 at the start of sheet feeding. Accordingly, the retry operation can be performed at the start of sheet feeding only when the paper sheet satisfies the paper type conditions of a paper type with a high possibility of a paper jam. Thus, a decrease in productivity can be prevented.

Also, it is possible to determine, in accordance with the paper type conditions of the paper sheet, whether to set a predetermined contact time after the pickup roller 31 is pressed against the paper sheet through a pressing operation against the paper sheet till the operation to separate the pickup roller 31 from the paper sheet.

FIG. 10 shows an example of a table that shows correspondence between paper type conditions (paper types and basis weights) of paper sheets and operation types at the time of execution of the retry operation (pressing operation) on the pickup roller 31. In the example shown in FIG. 10, the operation types at the time of execution of the retry operation are classified into the two levels in accordance with sheet contact times: "type A: the contact time is 40 ms", and "type B: the pickup roller 31 is separated immediately after the contact (the contact time is 10 ms in the specification)".

As shown in FIG. 10, in cases where the paper sheet is "plain paper", the operation type at the time of execution of the retry operation is determined to be "type A", regardless of the basis weight (specifically, "257 to 450 gsm") with which the retry operation is to be performed. In cases where the paper sheet is "coated paper", the operation type at the time of execution of the retry operation is determined to be "type B", regardless of the basis weight (specifically, "217 to 450 gsm") with which the retry operation is to be performed.

That is, in the example shown in FIG. 10, in cases where the paper sheet is "plain paper", a predetermined contact time is set before the operation to separate the pickup roller 31 from the paper sheet is performed. In cases where the paper sheet is "coated paper", on the other hand, the operation to separate the pickup roller 31 from the paper sheet is performed, without a predetermined contact time.

As described above, whether to set a predetermined contact time after the pickup roller 31 is pressed against the paper sheet through a pressing operation against the paper sheet till the operation to separate the pickup roller 31 from the paper sheet is determined in accordance with the paper type conditions of the paper sheet. Accordingly, the contact time can be minimized for the paper sheets having the paper type conditions under which a paper jam easily occurs and the number of times the retry operation is performed should be increased. Thus, the efficiency of conveyance of paper sheets can be increased, without any decrease in productivity.

In a case where the retry operation is to be performed on the pickup roller 31, the time before a paper jam is detected may be extended.

With this, the time for performing the retry operation can be secured. Thus, generation of a downtime due to a paper jam that can be solved by the retry operation can be prevented.

It is also possible to determine, in accordance with the paper type conditions of the paper sheet, the number of times the retry operation is to be performed on the pickup roller 31, the intervals at which the retry operation is to be performed, and the extended amount of time before a paper jam is detected.

FIG. 11 shows an example of a table that shows correspondence among paper type conditions (paper types and basis weights) of paper sheets, the number of times the retry operation is to be performed on the pickup roller 31, the intervals at which the retry operation is to be performed, and the extended amount of time before a paper jam is detected.

As shown in FIG. 11, in cases where the paper sheet is "plain paper", the number of times the retry operation is to be performed is determined to be "3" when the basis weight is "257 to 300 gsm", and is determined to be "5" when the basis weight is "301 to 450 gsm". In cases where the paper sheet is "coated paper", the number of times the retry operation is to be performed is determined to be "10" when the basis weight is "217 to 256 gsm", is determined to be "15" when the basis weight is "257 to 300 gsm", and is determined to be "20" when the basis weight is "301 to 450 gsm".

Meanwhile, in cases where the paper sheet is "plain paper", the intervals at which the retry operation is to be performed is determined to be "40 msec", regardless of the basis weight (specifically, "257 to 450 gsm") with which the retry operation is to be performed. In cases where the paper sheet is "coated paper", the intervals at which the retry operation is to be performed is determined to be "10 msec", regardless of the basis weight (specifically, "217 to 450 gsm") with which the retry operation is to be performed.

Further, in cases where the paper sheet is "plain paper", the extended amount of time before a paper jam is detected is determined to be "240 msec" when the basis weight is "257 to 300 gsm", and is determined to be "400 msec" when the basis weight is "301 to 450 gsm". In cases where the paper sheet is "coated paper", the extended amount of time before a paper jam is detected is determined to be "200 msec" when the basis weight is "217 to 256 gsm", is determined to be "300 msec" when the basis weight is "257 to 300 gsm", and is determined to be "400 msec" when the basis weight is "301 to 450 gsm".

That is, in the example shown in FIG. 11, whether the paper sheet is "plain paper" or "coated paper", the retry operation is performed a larger number of times, as the basis weight of the paper sheet becomes larger. Also, whether the paper sheet is "plain paper" or "coated paper", the extended amount of time before a paper jam is detected is made longer, as the basis weight of the paper sheet becomes larger.

As described above, the number of times the retry operation is to be performed on the pickup roller 31, the intervals at which the retry operation is to be performed, and the extended amount of time before a paper jam is detected are determined in accordance with the paper type conditions of the paper sheet. Accordingly, the retry operation on the pickup roller 31 can be finely controlled in accordance with the possibility of a paper jam. Thus, an increase in the efficiency of sheet conveyance and a high productivity can be achieved in a balanced manner.

Further, in a case where the storage 12 stores sheet feed information (information related to sheet feeding, including the paper type conditions, the number of times the retry operation is to be performed, the intervals at which the retry operation is to be performed, the extended amount of time before paper jam detection, and the like) for sheet feeding, and sheet feeding is performed under the same settings as the sheet feed information stored in the storage 12, it is possible to prepare a feedback circuit that determines the number of times the retry operation is to be performed, the intervals at which the retry operation is to be performed, the extended amount of time before paper jam detection, in accordance with the sheet feed information stored in the storage 12.

As described above, in a case where sheet feeding is performed under the same settings as the sheet feed information stored in the storage 12, the number of times the retry operation is to be performed, the intervals at which the retry operation is to be performed, and the extended amount of time before a paper jam is detected are determined in accordance with the sheet feed information stored in the storage 12. Accordingly, the retry operation can be performed under the optimum conditions at the time of sheet feeding. Thus, the efficiency of sheet conveyance can be increased in a reliable manner.

In a case where a paper jam occurs at a higher frequency than a predetermined frequency after the retry operation under the same settings, the display 14 may be made to display a predetermined warning. Here, the predetermined frequency is such a frequency that trouble in the conveyance system such as the rollers in the apparatus is suspected, for example. The predetermined warning is a warning to prompt cleaning of the rollers, a warning to prompt replacement of the rollers, or the like.

As described above, in a case where a paper jam occurs at a higher frequency than the predetermined frequency after the retry operation, the display 14 is made to display the predetermined warning. Accordingly, if trouble in the conveyance system such as the rollers in the apparatus is suspected, for example, the user can be notified of that. Thus, a critical failure in the apparatus can be prevented, and generation of a long downtime can be avoided.

Modifications may be made to the specific structures and the specific operations of the respective devices constituting the image forming apparatus, without departing from the scope of the invention.

Although embodiments of the present invention have been described and illustrated in detail, it is clearly understood that the same is by way of illustration and example only and not limitation, the scope of the present invention should be interpreted by terms of the appended claims.

What is claimed is:

1. A sheet feeder device comprising:

a pickup roller that separates paper sheets placed on a manual feed tray from one another, and transfers a paper sheet;

a pair of sheet feed rollers that include an upper feed roller and a lower feed roller, form a sheet nip portion when the upper feed roller and the lower feed roller are pressed against each other, and transfer the paper sheet transferred from the pickup roller;

a top edge vibrator that vibrates a top edge of the paper sheet, the top edge vibrator being located on an upstream side of the pair of sheet feed rollers in a conveyance direction; and a hardware processor that controls sheet feeding of the paper sheets placed on the manual feed tray, wherein, when a predetermined condition is satisfied in the sheet feeding, the hardware processor controls the top edge vibrator, to vibrate the top edge of the paper sheet; and wherein the hardware processor determines, in accordance with a paper type condition of the paper sheet, whether to set a predetermined contact time after the pickup roller is pressed against the paper sheet through a pressing operation till a separating operation to separate the pickup roller from the paper sheet.

2. The sheet feeder device according to claim 1, wherein the pickup roller functions as the top edge vibrator, and, when a predetermined condition is satisfied in the sheet feeding, the hardware processor vibrates the top edge of the paper sheet by performing the separating operation to separate the pickup roller from a paper sheet and the pressing operation to press the pickup roller against the paper sheet.

3. The sheet feeder device according to claim 1, further comprising a top edge detector that detects the top edge of the paper sheet, the top edge detector being located on a downstream side of the pair of sheet feed rollers in the conveyance direction, wherein, when the top edge of the paper sheet is not detected by the top edge detector within a predetermined time since a start of the sheet feeding, the hardware processor vibrates the top edge of the paper sheet.

4. The sheet feeder device according to claim 3, wherein after vibrating the top edge of the paper sheet, the hardware processor vibrates the top edge of the paper sheet at predetermined time intervals until the top edge of the paper sheet is detected by the top edge detector.

5. The sheet feeder device according to claim 1, wherein a conveyance path for the paper sheet placed on the manual feed tray is designed to bend between the pickup roller and the pair of sheet feed rollers.

6. The sheet feeder device according to claim 1, further comprising a preliminary separating plate located between the pickup roller and the pair of sheet feed rollers, wherein the preliminary separating plate is positioned to protrude upward from a straight line connecting an upper limit position of the paper sheet placed on the manual feed tray to the sheet nip portion.

7. The sheet feeder device according to claim 1, wherein the manual feed tray is located at a higher position than the sheet nip portion.

8. The sheet feeder device according to claim 1, wherein when the paper sheet satisfies a predetermined paper type condition, the hardware processor vibrates the top edge of the paper sheet at a start of the sheet feeding.

9. The sheet feeder device according to claim 1, wherein when vibrating the top edge of the paper sheet, the hardware processor extends a time before a paper jam is detected.

10. The sheet feeder device according to claim 1, further comprising a storage that stores sheet feed information at a time of sheet feeding, wherein, when sheet feeding is performed under the same settings as the sheet feed information stored in the storage, the hardware processor determines, in accordance with the sheet feed information stored in the storage, the number of times a vibrating operation to vibrate the top edge of the paper sheet is to be performed, intervals at which the vibrating operation is to be performed, and an extended amount of time before a paper jam is detected.

11. The sheet feeder device according to claim 1, wherein when a paper jam occurs at a higher frequency than a predetermined frequency under the same settings after a vibrating operation to vibrate the top edge of the paper sheet, the hardware processor causes a display to display a predetermined warning.

12. An image forming apparatus comprising:

the sheet feeder device according to claim 1, the sheet feeder device transferring a paper sheet placed on a manual feed tray; and an image forming part that forms an image on the paper sheet supplied from the sheet feeder device.

13. A sheet feeder device comprising:

a pickup roller that separates paper sheets placed on a manual feed tray from one another, and transfers a paper sheet;

a pair of sheet feed rollers that include an upper feed roller and a lower feed roller, form a sheet nip portion when the upper feed roller and the lower feed roller are pressed against each other, and transfer the paper sheet transferred from the pickup roller;

a top edge vibrator that vibrates a top edge of the paper sheet, the top edge vibrator being located on an upstream side of the pair of sheet feed rollers in a conveyance direction; and a hardware processor that controls sheet feeding of the paper sheets placed on the manual feed tray, wherein, when a predetermined condition is satisfied in the sheet feeding, the hardware processor controls the top edge vibrator, to vibrate the top edge of the paper sheet; and wherein in accordance with a paper type condition of the paper sheet, the hardware processor determines the number of times a vibrating operation to vibrate the top edge of the paper sheet is to be performed, intervals at which the vibrating operation is to be performed, and an extended amount of time before a paper jam is detected.

* * * * *